US005689954A

United States Patent [19]

Blöcker et al.

[11] Patent Number: 5,689,954

[45] Date of Patent: Nov. 25, 1997

[54] EXHAUST GAS MANIFOLD FOR AN INTERNAL COMBUSTION ENGINE AND METHOD OF MAKING SUCH EXHAUST GAS MANIFOLD

[75] Inventors: Henning Blöcker, Stelle; Pierre Bonny, Hamburg; Thomas Hülsberg, Rosengarten; Ralf Pünjer, Hamburg, all of Germany

[73] Assignee: Mercedes-Benz A.G., Stuttgart, Germany

[21] Appl. No.: 616,670

[22] Filed: Mar. 15, 1996

[30] Foreign Application Priority Data

Apr. 13, 1995 [DE] Germany ..... 19514020.6

[51] Int. Cl.[6] ..... F01N 7/00

[52] U.S. Cl. ..... 60/322; 60/323; 60/272; 138/155; 285/226

[58] Field of Search ..... 60/322, 323, 272; 138/155, DIG. 10; 285/115, 116, 187, 223, 226

[56] References Cited

U.S. PATENT DOCUMENTS

| | | | |
|---|---|---|---|
| 2,470,989 | 5/1949 | Keller et al. | 285/226 |
| 2,563,578 | 8/1951 | Candee | 285/226 |
| 2,611,238 | 9/1952 | Fryer, Jr. | 60/322 |
| 2,832,613 | 4/1958 | Farrar et al. | 285/226 |
| 3,459,444 | 8/1969 | Rofe | 285/226 |
| 4,475,341 | 10/1984 | Inoue et al. | 60/605 |
| 4,793,384 | 12/1988 | Lalikos et al. | 138/121 |
| 4,867,269 | 9/1989 | Lalikos et al. | 181/207 |
| 5,159,811 | 11/1992 | Hefler et al. | 60/322 |
| 5,331,810 | 7/1994 | Ingermann et al. | 60/322 |

FOREIGN PATENT DOCUMENTS

| | | |
|---|---|---|
| 0 171 624 | 2/1986 | European Pat. Off. . |
| 0 356 378 | 2/1990 | European Pat. Off. . |
| 34 27 746 | 1/1986 | Germany . |
| 34 27 364 | 2/1986 | Germany . |
| 35 00568 | 7/1986 | Germany . |
| 240033 | 3/1946 | Switzerland . |
| 465484 | 7/1975 | U.S.S.R. . |
| 2122683 | 1/1984 | United Kingdom . |

*Primary Examiner*—Ira S. Lazarus
*Assistant Examiner*—Ljiljana V. Ciric
*Attorney, Agent, or Firm*—Klaus J. Bach

[57] ABSTRACT

An exhaust manifold for an internal combustion engine with at least two cylinders includes at least two adjacent connection branches which are interconnected by collection pipe sections having an expansion compensating bellows for accommodating differential thermal expansion therebetween and a gas flow guide pipe structure which extends into the bellows. At least one of the collection pipe sections comprises a multi-layered pipe wall with which the expansion compensating bellows is integrally formed.

8 Claims, 3 Drawing Sheets

EXHAUST GAS MANIFOLD FOR AN INTERNAL COMBUSTION ENGINE AND METHOD OF MAKING SUCH EXHAUST GAS MANIFOLD

BACKGROUND OF THE INVENTION

The invention relates to an exhaust gas manifold particularly for an internal combustion engine of a motor vehicle.

DE 35 00 568 A1 discloses an exhaust gas manifold of heat resistant steel sheet which comprises a collecting pipe with several connecting pieces leading to exhaust ports of the cylinderhead. The respective pipe sections of the exhaust manifold are provided with expansion bellows-like sections so that the manifold is resilient in axial direction. The bellows-like expansion sections serve to compensate for changes in length occurring as a result of temperature changes.

Such exhaust gas manifolds are manufactured by internal high pressure molding wherein the pipe portion is received in a corresponding die which determines the position and the extent of the corrugations. Since, with the known arrangement, axial feeding of the material during the internal high pressure forming step is possible only to an insufficient degree, the pipe walls are much weakened in the area of the corrugations. In addition, because of the rapidly changing cross-sections in the corrugated pipe area, the exhaust gas flow is subject to turbulences which lead to flow losses and noise emissions.

It is therefore the object of the invention to provide an exhaust manifold with at least two connecting pieces which are interconnected by corrugated pipe sections accommodating differential thermal expansion, which can be manufactured in a simple manner, which provides for reduced noise emissions, and which increases the life of the exhaust manifold.

SUMMARY OF THE INVENTION

An exhaust manifold for an internal combustion engine having at least two cylinders includes corresponding exhaust branches which are interconnected by collecting pipe sections having a multi-layered wall structure. These pipe sections include bellows which are integrally formed with the multi-layered wall structure of the pipe sections, and also include a gas flow guide pipe structure with an elongated stub extending from one end of the bellows into, and through, the bellows to protect the bellows from the hot exhaust gases.

Since the exhaust gas pipe is formed simply by a stub extension of a pipe section, there is no increase in manufacturing costs. There are further no additional flow resistance losses. In addition, noise emissions are reduced and the life of the exhaust manifold is increased. The whole arrangement provides for good temperature resistance and is relatively inexpensive to manufacture.

The stub extension which is part of the exhaust pipe may have different shapes. Particularly suitable is a cylindrical shape or the shape of a cone with a small convergence angle. In a preferred arrangement, the stub extension is formed at the end of one pipe section and the corrugated tubular expansion compensation structure is formed at the end of the adjacent pipe section and the corrugated tubular expansion compensation structure extends over, and sealingly encompasses, the stub extension. With this arrangement, it is possible during the manufacture of the corrugations for the corrugated pipe section to feed-in the pipe material in axial direction so that the pipe does not need to be axially stretched where the corrugations are formed and the walls of this pipe sections are not weakened excessively. Since the free end of the expansion compensation structure engages the outer wall of the adjacent pipe section, it can be easily welded thereto in a gas tight manner. Preferably, the compensation section has a cylindrical end portion whose inner diameter corresponds to the outer diameter of the adjacent pipe section which is received therein.

Suitably, the adjacent pipe section extends over the length of the corrugated tubular expansion compensation structure and slightly into the adjacent pipe section. It is made sure in this way that, even with some axial extension of the compensator section because of temperature changes, the gas flow conducting pipe section always extends into the cylindrical portion of the subsequent pipe section. The exhaust gas manifold may consist of different materials; even the particular pipe sections may consist of different materials depending on particular requirements. Preferably, the tube section which includes the corrugated tubular expansion compensation structure is a multiwall structure including at least two wall layers whereas the tube sections with the stub ends are single wall structures.

In another embodiment, both pipe sections comprise multiple walls consisting of separate inner pipes and a common outer pipe. In this case the inner pipes have adjacent ends in the form of stubs which define each a part of the exhaust gas pipe and the outer pipe extends over both pipe sections. In the area of the axial length of the stubs, the outer pipe forms the corrugated tubular expansion compensation bellows. With such an arrangement, it is not necessary to interconnect the pipe sections and to form a gas tight connection between the stubs.

If the exhaust gas manifold or sections thereof consist of a multilayer material, it is advantageous if the radially outer material layer consists of a ferritic steel and the radially inner material layer consists of a heat resistant austenitic steel. Multi-layer pipe sections have the advantage that they have greater elastic flexibility than single wall pipes of the same outer diameter since the flexibility decreases proportionally with increasing wall thickness of the pipe.

The pipe sections, particularly those pipe sections which include the compensating structures preferably consist of pipe shaped by interior high pressure transformation. Generally, it is sufficient to provide two expansion compensating corrugations wherein the axial distance between the centers of the two corrugations is about 1.5 to 1.7 times the radius of the corrugated wall area. With these values, the corrugation radii are sufficiently large to avoid material stretching and stresses. But it is noted that the use of other shapes and numbers for the corrugations is possible depending on requirements and design configurations.

Below, the invention will be described in greater detail on the basis of the accompanying drawings.

BRIEF DESCRIPTION OF THE DRAWINGS

FIGS. 4*a* to 4*d* show a number of procedural steps for manufacturing the exhaust gas manifold section of FIG. 3.

DESCRIPTION OF PREFERRED EMBODIMENTS

Figure 1:
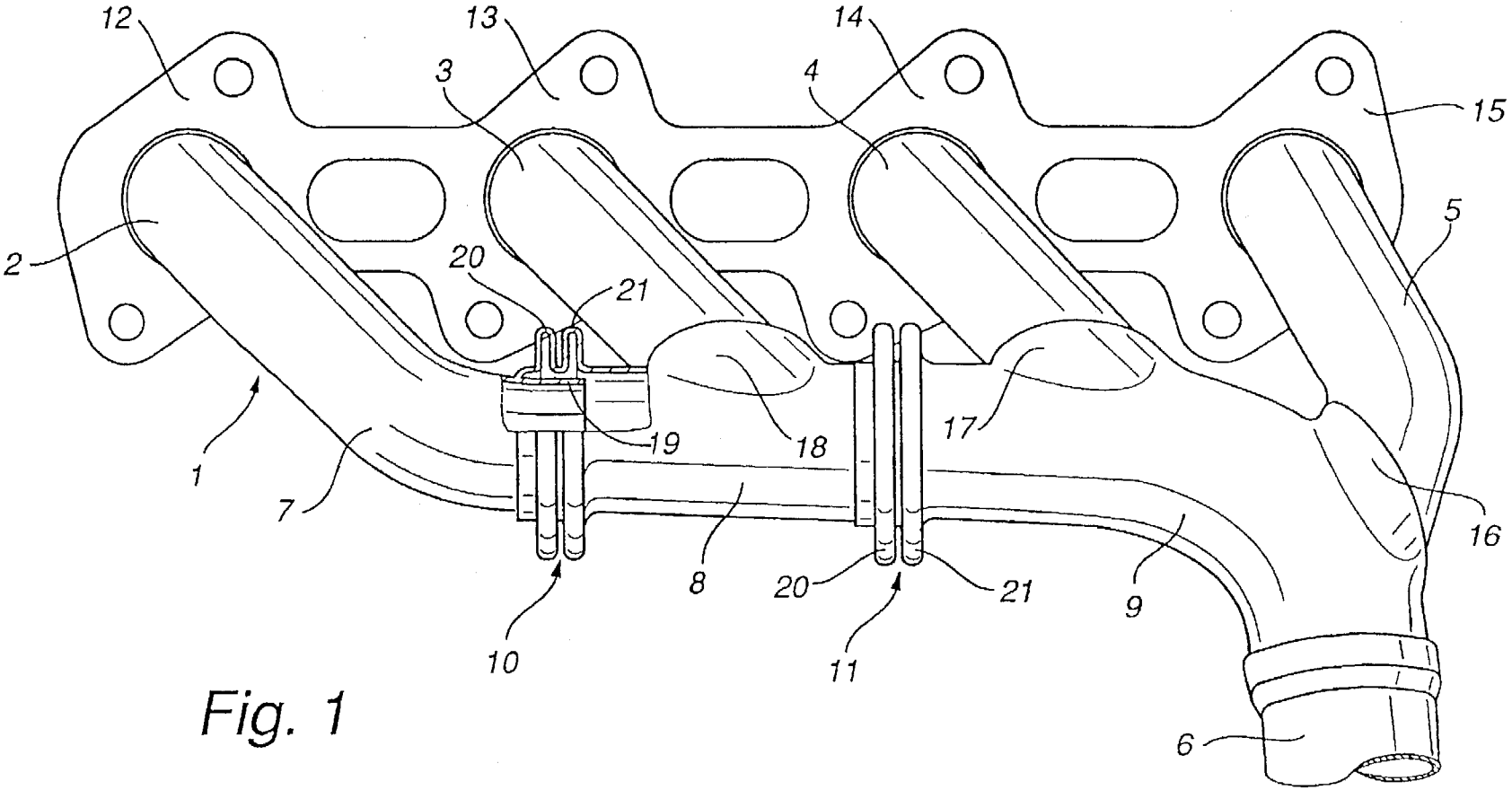
FIG. 1 shows an exhaust gas manifold with several pipe sections and two expansion compensating structures.

FIG. 1 shows an exhaust gas manifold 1 having four connection branches 2, 3, 4, and 5 with associated flanges 12, 13, 14 and 15 and pipe sections 7, 8, and 9 interconnecting the connection branches. Such a manifold is mounted to the cylinderhead of an internal combustion engine of a vehicle. At the exit end of the manifold, an exhaust pipe 6 is provided which is mounted to the pipe section 9. The pipe section 9 includes two neck portions 16 and 17 to which the connection branches 4 and 5 are welded. The first connection branch 2 is formed integrally with the first pipe section 7 and the intermediate pipe section 8 includes a neck portion 18 to which the connection branch 3 is welded.

For accommodating differential expansion of the pipe sections, a first expansion compensation structure 10 is arranged between the pipe sections 7 and 8 and a second expansion compensation structure 11 is arranged between the pipe sections 8 and 9. The expansion compensation structures 10 and 11 each comprise two flexible corrugations 20, 21 and are formed integrally onto one of the pipe sections 8 and 9, respectively. The respective adjacent pipe section 7 or 8, respectively, has a stub 19 which extends into the expansion compensation structure 10 or 11 formed onto the other pipe section 8 or 9, respectively, forming a flow guide pipe through the expansion compensation structures 10 and 11. The stub is preferably circular in cross-section but it may also be oval.

Figure 2A:
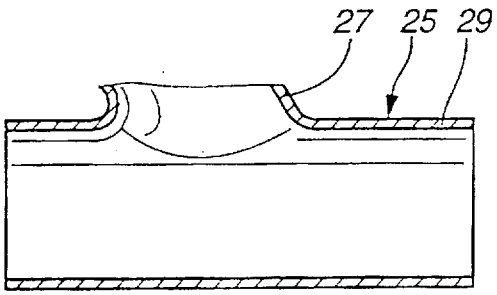
FIG. 2*a* is a cross-sectional view of a pipe section with a connection.
Figure 2B:
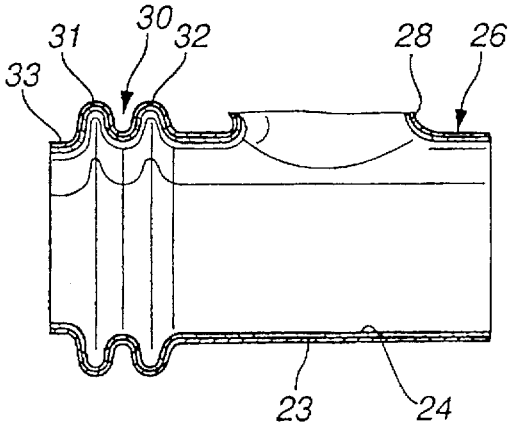
FIG. 2*b* is a cross-sectional view of a pipe section with an expansion compensating structure.

FIGS. 2*a* and 2*b* show a pipe section 25 with a neck portion 27 formed thereon and a pipe section 26 with a neck portion 28. At its end adjacent the pipe section 26, the pipe section 25 has a stub 29 which really is an extension of the pipe section 25 as it has the same diameter. As shown in FIG. 2*a*, the pipe section 25 consists of a single wall pipe but it may be a multiple wall pipe as it is shown for example in FIG. 2*b*.

The pipe section 26 shown in FIG. 2*b* comprises two wall layers, the radially outer layer being designated by the reference numeral 23 and the radially inner layer being designated by reference numeral 24. For the wall layers, different material combinations may be utilized. The inner layer may consist, for example, of a heat resistant austenitic steel and the outer of a ferritic steel. Adjacent the pipe section 25, an expansion compensation structure 30 is formed into the pipe section 26. The expansion compensation structure 30 comprises two expansion corrugations 31 and 32 with a cylindrical connecting section 33 formed at the front end whose inside diameter corresponds to the outside diameter of the stub 29. Otherwise, the diameter of the pipe section 26 is somewhat greater than that of the cylindrical connecting section 33.

Figure 2C:
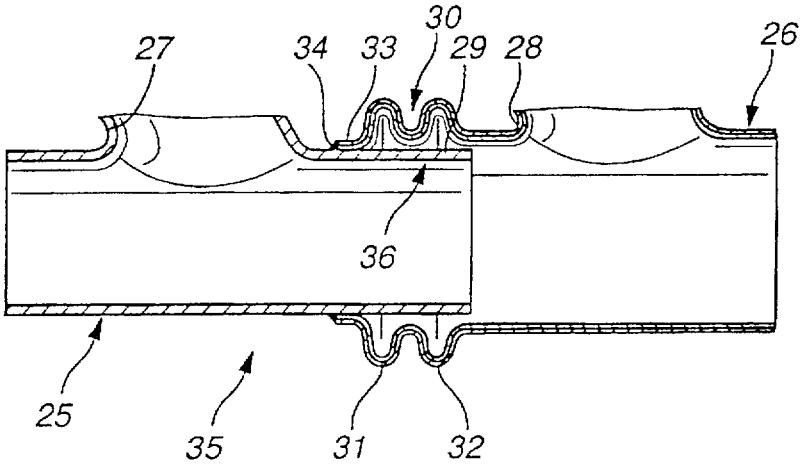
FIG. 2*c* is a cross-sectional view showing the pipe sections of FIGS. 2*a* and 2*b* interconnected.

FIG. 2*c* shows the pipe sections 25 and 26 assembled as in the completed manifold wherein the stub 29 of the pipe section 25 is inserted into the pipe section 26 to such an extent that it forms a gas guide membrane extending over the full axial length of the expansion compensation structure. The cylindrical pipe section 33 is sealingly connected to the pipe section 25 by means of a welding seam 34.

Figure 3:
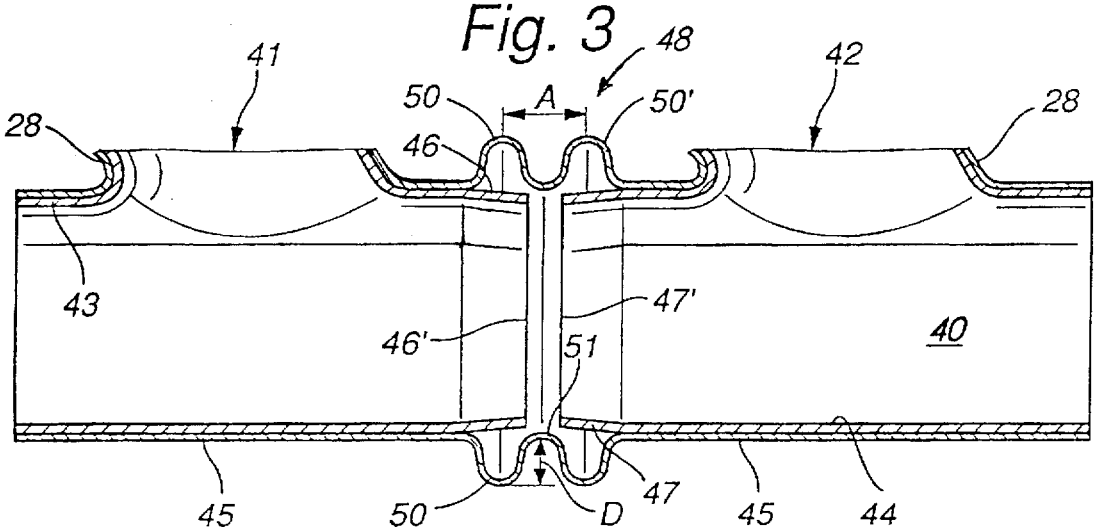
FIG. 3 shows another embodiment of the invention.

The embodiment of an exhaust gas collecting pipe 40 as shown in FIG. 3 comprises two double wall pipe sections 41 and 42, the section 41 having an inner pipe 43 and the pipe section 42 having an inner pipe 44. An outer pipe 45 extends over the full length of the inner pipes 43 and 44. The inner pipes 43 and 44 have at their facing ends slightly conical stubs 46, 47 whose front faces 46', 47' are disposed adjacent but spaced from one another. Over the axial length of the two stubs 46, 47, the outer pipe 45 is corrugated to form an expansion compensation structure 48 including two corrugations 50, 50'. The inner pipes 43, 44 preferably have a greater wall thickness than the outer pipe. The corrugations 49, 49' of the expansion compensation structure are preferably so shaped that the axial distance A between the centers of the two corrugations 50, 50' is 1.5 to 0.7 times the radial difference D between the greatest and smallest radius of the corrugations that is the length between the wave top 50 and the wave bottom 51 of the corrugation. In this way, curvatures with small radii which would result in large material stresses are avoided.

As shown in FIG. 3, the exhaust gas collecting pipe 40 is provided, at each pipe section, with a neck portion 28 20 corresponding to the neck portions shown in FIG. 2*c*. The gap between the front faces 46', 47' of the stubs 46, 47 is disposed in the same plane as the inner corrugation waveform 51 of the expansion compensation structure 48 so that the inner wall of corrugation restriction 51 serves as radial cover for the gap. The two stubs 46 and 47 together define a gas guide structure.

FIG. 4*a* shows the outer pipe 45 into which the inner pipes 43 and 44 with their conical stubs 46 and 47 are inserted. The inner pipes 43 and 44 are inserted into the outer pipe 45 by the application of forces as indicated by arrows 59. The lengths of the inner pipes 43 and 44 are so selected that a space remains between the faces 46' and 47' of the stubs 46 and 47 when the inner pipes 43 and 44 are fully inserted as it is shown in FIG. 4*b*.

Figure 4C:
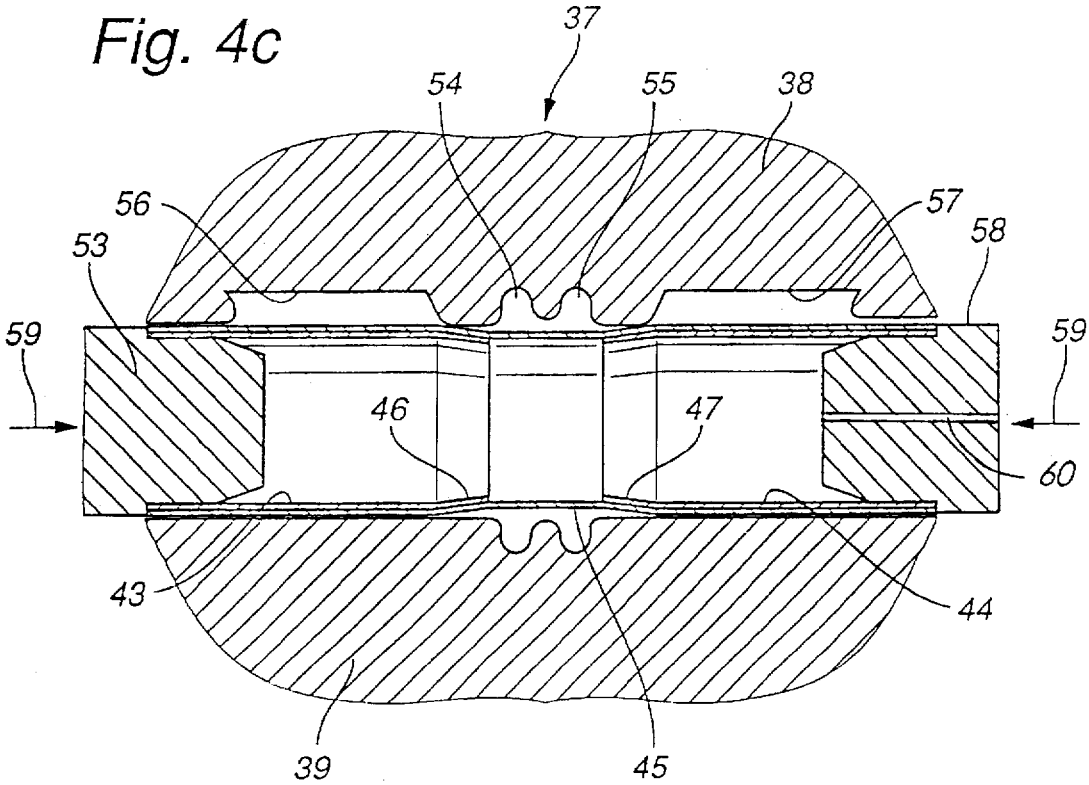
Figure 4D:
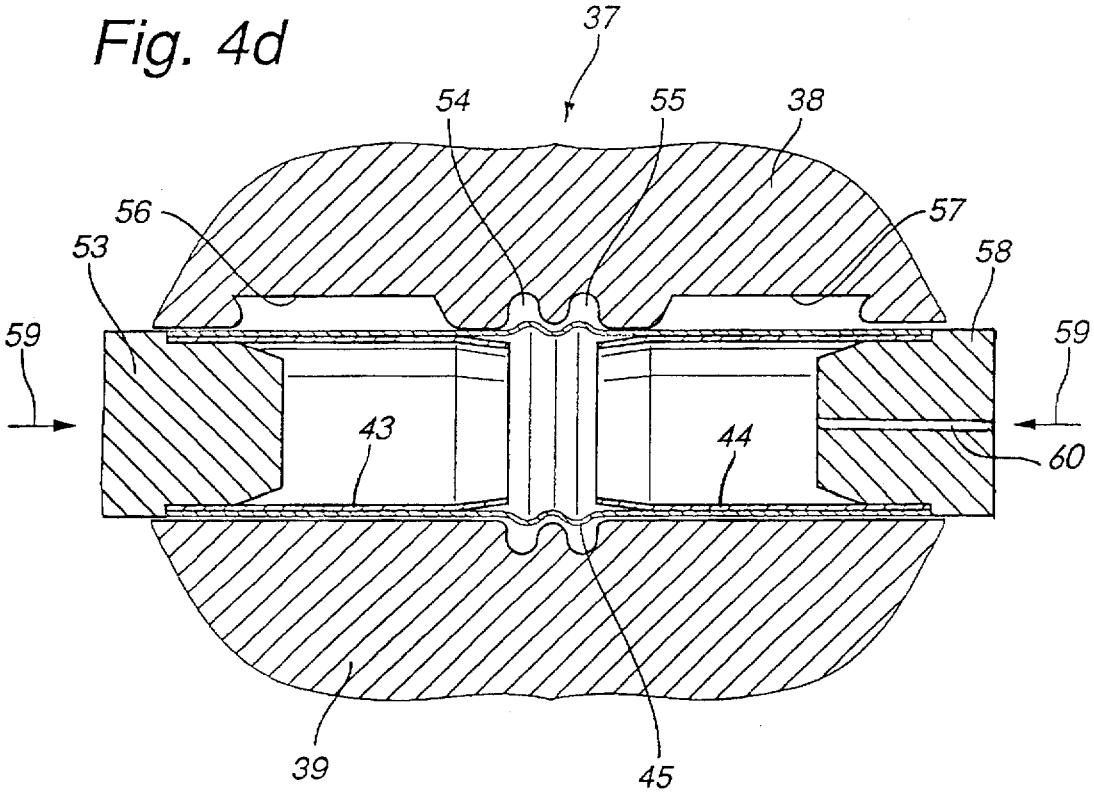

The compound pipe shown in FIG. 4*b* which consists of inner pipe sections 43, 44 and outer tube 45 is then placed into a die 37 consisting of an upper part 38 and a lower part 39. When closed around the tube assembly of FIG. 4*b* as shown in FIG. 4*c*, the upper and lower die parts together define annular grooves 54 and 55 in the axial center thereof. Offset from the center, the upper part 38 of the die 37 includes recesses 54, 55 in the shape of the neck portion 17, 18 (FIG. 1).

By the insertion of taper plugs 53, 58 into the opposite ends of the compound tube, the tube is sealingly closed. When the top part 38 and the bottom part 39 of the die 37 are closed as shown in FIG. 4*c*, the interior of the compound tube is pressurized by a fluid with the pressure $P_i$. The fluid under pressure is introduced for example through passage 60. Since in the area of the annular grooves 54 and 55 only the outer pipe 45 is present, the outer tube is expanded by the internal fluid pressure into the annular grooves 54 and 55 of the die 37. In order to prevent excessive material stretching of the outer pipe, axial forces are applied at the same time to the taper plugs 53 and 58 in the direction as indicated by the arrows 59 whereby the pipe sections 42, 44 are moved toward the center to facilitate the formation of the corrugations. In this manner, also the distance between the front faces of the inner pipe walls is reduced.

The outer pipe 45 is shaped and the pipe sections 43, 44 are moved toward each other until the corrugations in the outer tube abut the walls of the annular grooves 54 and 55 in the die 37. The neck portions 28 are formed in the same manner by excess internal pressure by which the material of the pipe wall sections 43, 44 is pressed into the cavities 56, 57 in the die 37. Then the internal pressure is completely released and the taper plugs 53 and 58 are removed and the parts 38 and 39 of the die are opened.

What is claimed is:

1. An exhaust manifold, particularly for an internal combustion engine having at least two cylinders, said exhaust manifold having at least two exhaust branches and both a first pipe section and a second pipe section disposed between two of the at least two adjacent exhaust branches, said first pipe section comprising a multi-layered wall structure including at least two material layers and including an expansion compensation structure formed integrally with the multilayered wall structure, said expansion compensation structure comprising a bellows structure with at least two expansion accommodating corrugations, said second pipe section comprising a single-layered wall structure and including an elongated stub portion formed at one end of the second pipe section, said elongated stub portion axially disposed as a gas flow guide pipe extending inside said bellows structure, and said first and second pipe sections each including a radially disposed neck portion for joining each of the pipe sections with the corresponding exhaust branch, wherein each radially disposed neck portion is formed integrally with the corresponding pipe section.

2. An exhaust manifold according to claim 1, wherein said elongated portion is circular in cross-section.

3. An exhaust manifold according to claim 1, wherein said elongated stub portion is oval in cross-section.

4. An exhaust manifold according to claim 1, elongated stub portion is conical.

5. An exhaust manifold according to claim 1, wherein said elongated stub portion is sealingly received in said bellows structure.

6. An exhaust manifold according to claim 5, wherein said elongated stub portion extends at least over the entire length of said bellows structure.

7. An exhaust manifold according to claim 5, wherein the radially outermost of said multi-layered wall structure consists of a ferritic steel and the radially innermost layer consists of an austenitic steel.

8. An exhaust manifold, particularly for an internal combustion engine having at least two cylinders, said exhaust manifold having at least two exhaust branches and including both a first inner pipe section and a second inner pipe section and an outer pipe section disposed between two of the at least two adjacent exhaust branches, said outer pipe section including an expansion structure formed integrally with the outer pipe section and comprising a bellows structure with at least two expansion accommodating corrugations, said first pipe section comprising a first elongated stub portion formed at one end thereof and extending in axial alignment with a second elongated stub portion formed at one end of the second inner pipe wherein the first elongated stub portion is axially spaced from the second elongated stub portion to form a gap for accommodating differential thermal expansion therebetween, said outer pipe section enveloping both the first inner pipe section and the second inner pipe section, said outer pipe section bridging the first and second inner pipe sections via the bellows structure, said outer pipe section and said first inner pipe section extending radially outward to integrally form a first neck portion for connecting with the first of the at least two exhaust branches, and said outer pipe section and said second inner pipe section extending radially outward to integrally form a second neck portion for connecting with the second of the at least two exhaust branches.

* * * * *